US010072375B2

(12) United States Patent
Colombo et al.

(10) Patent No.: US 10,072,375 B2
(45) Date of Patent: Sep. 11, 2018

(54) METHOD FOR DRYING CLOTHES IN A DRIER AND A MOISTURE ESTIMATION CONTROL TO OBTAIN AN AUTOMATIC CYCLE TERMINATION

(75) Inventors: Davide Colombo, Gerenzano (IT); Daniele Martinello, Besozzo (IT)

(73) Assignee: Whirlpool Corporation, Benton Harbor, MI (US)

( * ) Notice: Subject to any disclaimer, the term of this patent is extended or adjusted under 35 U.S.C. 154(b) by 1717 days.

(21) Appl. No.: 13/242,282

(22) Filed: Sep. 23, 2011

(65) Prior Publication Data

US 2012/0090191 A1 Apr. 19, 2012

(30) Foreign Application Priority Data

Oct. 15, 2010 (EP) ..... 10187667

(51) Int. Cl.
*F26B 5/06* (2006.01)
*D06F 58/28* (2006.01)

(52) U.S. Cl.
CPC ..... *D06F 58/28* (2013.01)

(58) Field of Classification Search
CPC ..... D06F 58/28
USPC ..... 34/282, 327, 443, 445, 446
See application file for complete search history.

(56) References Cited

U.S. PATENT DOCUMENTS

| | | | | |
|---|---|---|---|---|
| 4,112,589 | A * | 9/1978 | Palfrey et al. | 34/553 |
| 4,827,627 | A * | 5/1989 | Cardoso | 34/526 |
| 5,560,124 | A * | 10/1996 | Hart et al. | 34/493 |
| 6,199,300 | B1 * | 3/2001 | Heater et al. | 34/446 |
| 2006/0272177 | A1 * | 12/2006 | Pezier et al. | 34/528 |
| 2007/0163098 | A1 * | 7/2007 | Tomasi et al. | 28/100 |
| 2010/0115785 | A1 * | 5/2010 | Ben-Shmuel et al. | 34/260 |

FOREIGN PATENT DOCUMENTS

| | | | |
|---|---|---|---|
| EP | 1441062 | A1 | 7/2004 |
| EP | 2034086 | A1 | 3/2009 |
| JP | 9024198 | A | 1/1997 |
| WO | 199312284 | A1 | 6/1993 |

OTHER PUBLICATIONS

European Patent Application No. 10187667.0, filed Oct. 15, 2010, Applicant: Whirlpool Corporation. European Publication No. EP2441880A1, published Apr. 18, 2012.

* cited by examiner

*Primary Examiner* — Kenneth Rinehart
*Assistant Examiner* — Bao D Nguyen
(74) *Attorney, Agent, or Firm* — Diederiks & Whitelaw, PLC

(57) ABSTRACT

The power P of the heater of a dryer is regulated in order to heat up the air used to dry washed articles placed in the drying chamber to a temperature close to a set point temperature $T_{SET}$. The output signal of the regulator of the heater is used to estimate the moisture content of the fabrics and to terminate the drying cycle when a predefined moisture level is reached.

19 Claims, 5 Drawing Sheets

METHOD FOR DRYING CLOTHES IN A DRIER AND A MOISTURE ESTIMATION CONTROL TO OBTAIN AN AUTOMATIC CYCLE TERMINATION

BACKGROUND OF THE INVENTION

Field of the Invention

The present invention relates to a method for estimating the moisture content of fabrics in a drier during the drying cycle and for enabling an automatic cycle termination once a desired moisture level is reached.

As a drier it is here meant any appliance for drying clothes and fabrics and which is preferably for domestic use. The drier can be either a condensing drier or an air-vented drier. Preferably it is a condensing tumble drier for domestic use. The invention support either the heating system based on "electrical resistance" or systems known as "heat pump" system that makes use of a refrigerant cycle to heat the air.

Description of the Related Art

Methods for terminating the drying cycle of a drier when the desired drying level is achieved are known in the art.

A known simple method is based on the drying time length. The level of the residual moisture is assumed to be directly correlated with the drying time. The control unit counts the drying time and stops the drying cycle after the time manually set by the user has elapsed, leaving a certain level of residual moisture in the fabrics. This method requires the user to estimate the drying time and to set manually the dryer accordingly. As a result, this method does not provide excellent performances but drives to a waste of time and energy.

Another known method uses conductibility sensors in the form of metal stripes placed either in the drum or on the drum lifters. With such sensors it is measured the instantaneous resistance of the clothes contacting the stripes, which is linked with their moisture content: the higher is the resistance the dried are the clothes. The conductibility value read through these sensors is compared to a predefined/selected threshold value stored in the memory of the control unit. In the memory are stored a certain numbers of threshold values, each of them corresponding to a certain dryness level according to the number of drying programs offered by the machine to the user.

This method requires a quite complex manufacturing operation for fixing the conductibility sensors in the drying chamber. This method is particularly efficient when implemented in tumble driers, but it is less efficient when applied in driers wherein fabrics are not agitated/moved during the drying process. The method is however unsatisfactory when drying bulky items, that is items presenting high volume/surface and low mass. In these cases in fact, conductibility sensors do no enter in contact with the interior portion of the items.

Moreover, from EP-A-2034086 filed by the same applicant, the moisture retention of fabric inside the dryer is estimated using two temperature sensors: a first sensor placed nearby the heater at the inlet of the drying chamber, and used to avoid over temperatures; and a second sensor placed the near or at the outlet of the drying chamber used to control the air temperature linked with the clothes. In FIG. 1 it is possible to see the positioning of the two temperature sensors 1, 2.

The air temperature of the drying chamber is controlled with a closed loop temperature control, as described on FIG. 2 by modulating/controlling the power to be supplied by the heater. The moisture estimation module uses in input the heater temperature signal and the drying chamber temperature signal, measured through the two temperature sensors. When the estimated moisture retention matches or decreases below the desired/set value, the drying cycle is stopped. This method is preferably applicable to a tumble drier.

However, more than one temperature sensor is required to estimate the moisture content.

Further known methods use a relative humidity sensor or a weight sensor, and stop the drying cycle when a predefined threshold limit is reached. These methods require an "ad hoc" expensive sensor, while the other described methods use the same temperature sensors used for controlling the heater temperature.

Finally, in the art are also known methods using a single temperature sensor to automatically estimate the mass amount of clothes within the dryer. With this information the duration of the drying cycle is established accordingly. To be reliable this method requires having in input also the type of fabrics to be dried. This information is normally not accurate if automatically calculated, and it is preferably required to be inputted by the user, causing to the process become a manual process.

SUMMARY OF THE INVENTION

Aim of the present invention is a method which does not present the drawbacks of the prior art.

The above disadvantages are overcome thanks to the features listed in the appended claims.

BRIEF DESCRIPTION OF THE DRAWINGS

Other features and advantages of the present invention will become readily apparent to the skilled artisan from the following detailed description when read in light of the accompanying drawings, in which.

DETAILED DESCRIPTION OF THE PREFERRED EMBODIMENTS

Figure 8:
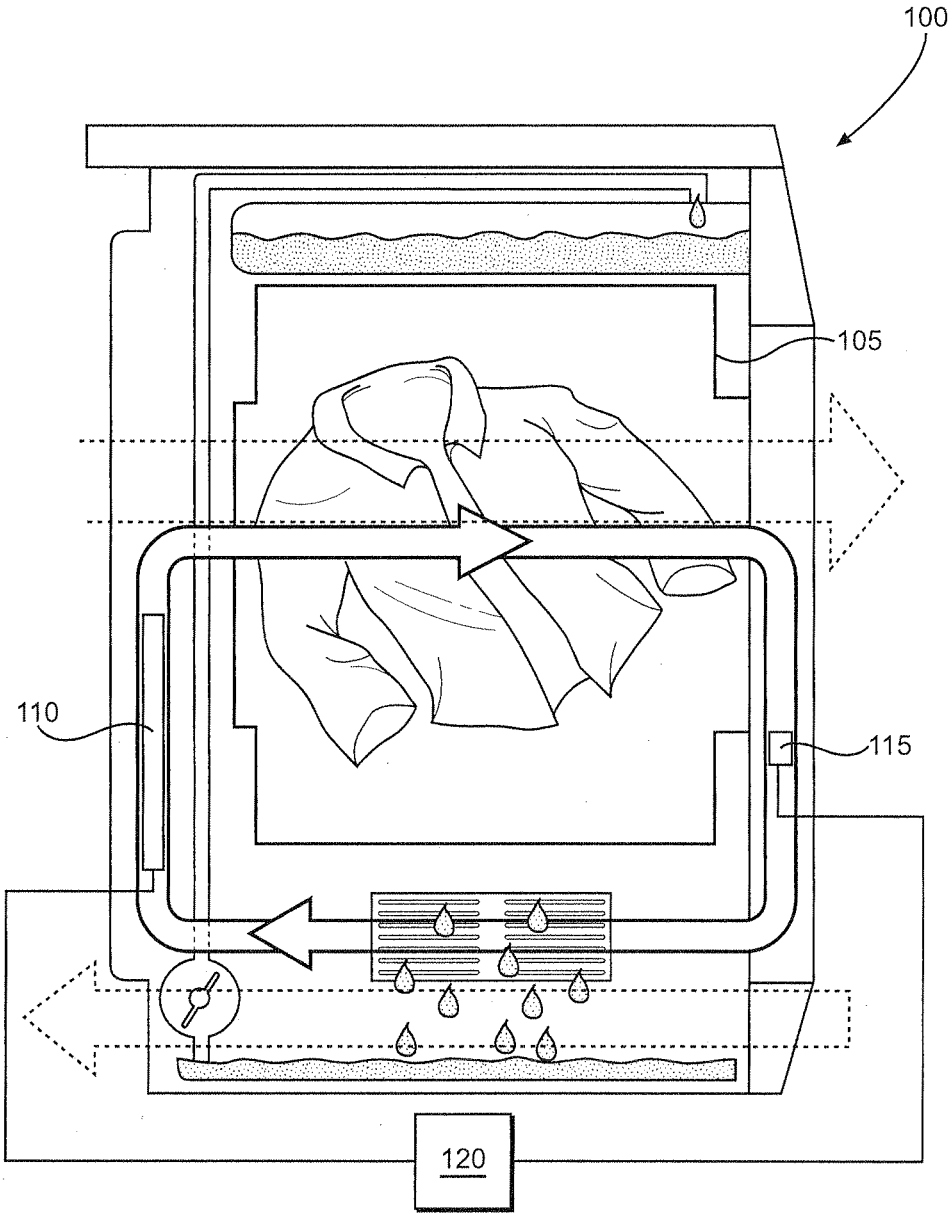
FIG. 8 shows a drier in accordance with the present invention.

Having regard to the accompanying drawings, the method of the present invention is described with reference to a tumble drier 100, as shown in FIG. 8. A tumble dryer implementing the method of the present invention typically includes the following components and functionalities:

- a drum 105 aimed at containing a certain amount of laundry articles and optionally rotationally driven with an electric motor;
- a heating element to heat the air to be blown inside the drum. The heater 110 is preferably a radiant heater even if other heating systems can be used.
- a blower (not shown) forcing the air through the drying chamber.
- a temperature sensor 115 to measure the a temperature $T_{OUT}$ linked with the laundry articles temperature within the chamber, for instance the air temperature within or at the outlet of the chamber.
- an air channel that conveys the air either outside the appliance (vented dryer) or to a condenser (condensing dryer);
- a control unit 120 for:
  - reading the sensor,
  - actuating the drum motor, the blower and the heating element,
  - implementing the temperature control of the air drying the clothes in order to regulate to a predetermined temperature set point $T_{SET}$ the temperature ($T_{OUT}$) related to the laundry articles,
  - implementing the estimation of the residual moisture retained from the clothes and fabrics during the drying cycle,
  - implementing an automatic cycle termination: when the estimated moisture reaches the desired threshold value the cycle is stopped. The threshold value depends on factor like: fabrics type, load mass, final moisture retention required, air flow rate and on the heater type.

Since the present invention requires a sensor to measure a temperature linked with the temperature of the laundry items, it follows that several dispositions of the sensor (connected to different parts/component of the dryer), or different types of sensors can be used. For instance it could be used a temperature sensor connected to the temperature of the refrigerant fluid;

The temperature set point $T_{SET}$ value is used by the control unit to as reference value for regulating the air temperature $T_{OUT}$ within the drying chamber. For the sake of simplify the temperature set point $T_{SET}$ is here considered to be constant, even if the profile of the set-point temperature can be changed during the drying cycle for obtaining different drying performances.

According to the invention the method starts when the temperature $T_{OUT}$ linked with the laundry articles reaches a steady state condition.

Figure 4:
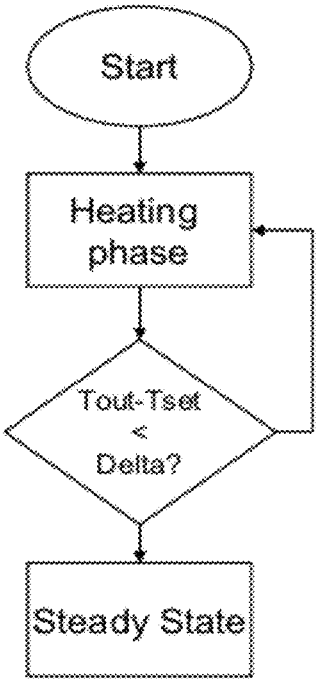
FIG. 4 is a flowchart diagram describing how to reach the steady condition of the drier before starting the method according to the present invention.

A steady condition is considered to be reached, when the air temperature $T_{OUT}$ is close to the temperature set point $T_{SET}$, as described in the flowchart of FIG. 4. An approach that could be used to identify the steady state condition is continuously evaluating the difference between temperature $T_{OUT}$ and $T_{SET}$, and determining when this difference is lower than a predefined amount.

Figure 1:
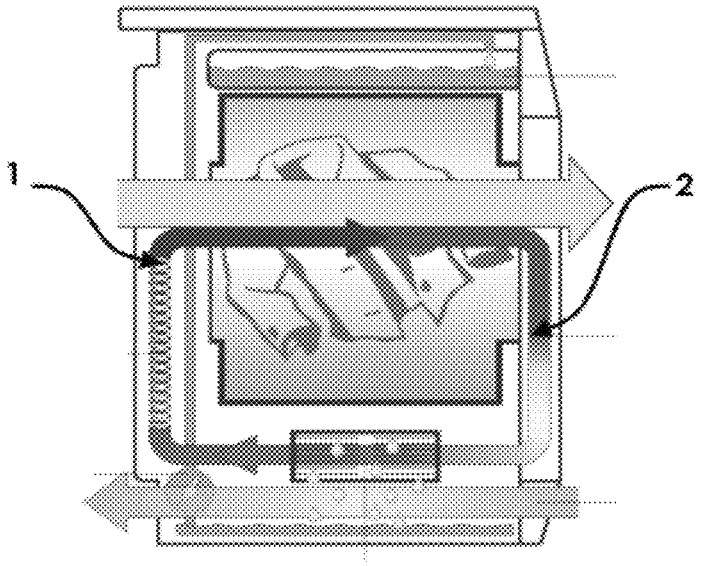
FIG. 1 shows the disposition of the temperature sensors in a drier known in the art.
Figure 2:
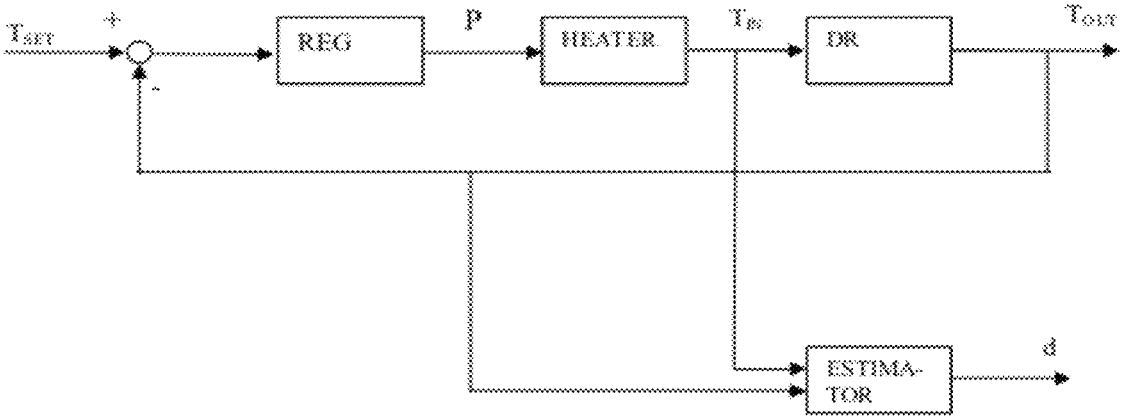
FIG. 2 is the schematic control diagram of a drier implementing a known method for estimating the moisture content.
Figure 3:
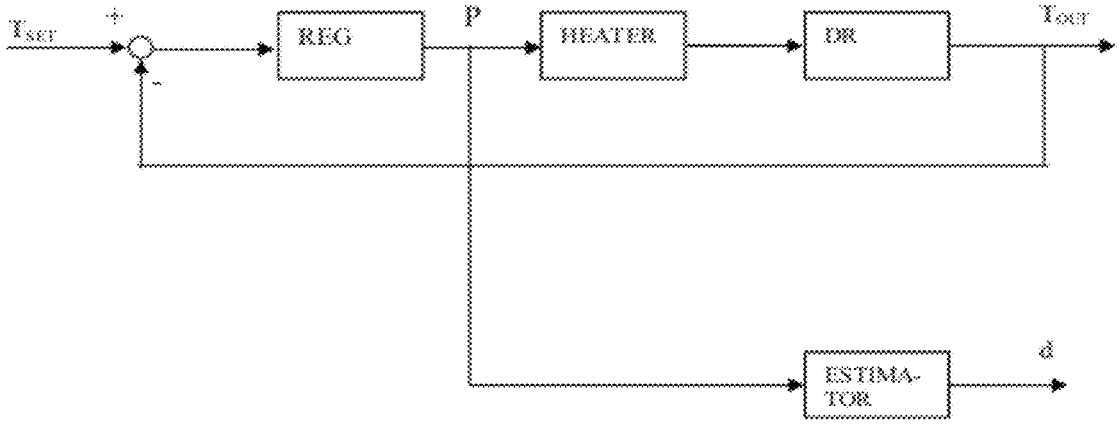
FIG. 3 is the schematic control diagram of a drier implementing a method for estimating the moisture content according to the present invention.

In FIG. 3 and is described in detail an example of temperature control according to the present invention for regulating the air temperature $T_{OUT}$. This temperature, at steady state condition is linked with the temperature of the laundry articles (clothes, fabrics) within the chamber. In particular, the temperature control described in this example is a closed loop control system which has in input the current value of the air temperature $T_{OUT}$ preferably measured with a temperature sensor at the output of the drying chamber. The air temperature $T_{OUT}$ is compared with the temperature set point $T_{SET}$. And their difference is sent in input to a controller REG. This controller REG produces in output a control signal P linked with the power to be supplied by the heater. This signal is used to control the heater for heating the air used to dry the laundry articles at a temperature close to the set point temperature $T_{SET}$. The blower is preferably activated with the heater at fixed speed. The controller REG can be for instance a PI controller or even more a sophisticated control type having in output a control signal linked with the power to be supplied by the heater. According to the present invention the signal P linked with, or corresponding to the power to be supplied by the heater is used to estimate the moisture retention of the laundry articles during the drying cycle. In fact, after the steady state condition is reached $T_{OUT}$ becomes substantially constant and the (controlled) power to be supplied by the heater is meanly used for the evaporation $P_{EV}$ of water from fabrics and to compensate power losses $P_{LOS}$.

$$P=P_{EV}+P_{LOS}. \tag{1}$$

Power losses $P_{LOS}$ depend on the temperature of clothes and so its magnitude can be considered constant when $T_{OUT}$ is in steady conditions.

During the drying cycle a power $P_{EV}$ is absorbed by the heater for the water evaporation and depends on dryness status of the laundry articles, which is strictly linked with the evaporation rate (dMR %) of the water in the clothes/fabrics.

The power required for the evaporation $P_{EV}$ is a function of the latent heat that is needed for the evaporation of water from clothes. At the beginning of the drying cycle, when the clothes are wet, the power $P_{EV}$ required for the evaporation reaches its maximum value of power absorption max(P) and then decreases till to disappear when the articles are dried, when only $P_{LOS}$ is supplied with the heater in order to compensate the power losses $P_{LOS}$.

By monitoring the variation of the power required by the system during the cycle it is possible to determine an estimation of the evaporation rate dMR %.

According to the invention the normalization (scaling) of the measured power to the max value of power absorbed max(P) during the drying phase, renders the evaluation independent from the heater nominal power.

$$P/\max(P)\approx Pev/\max(Pev)\approx dMR\ \%/\max(dMR\ \%) \tag{2}$$

When the variation of the evaporation rate becomes lower than a predetermined level (from the customer) the cycle can be terminated.

Figure 5:
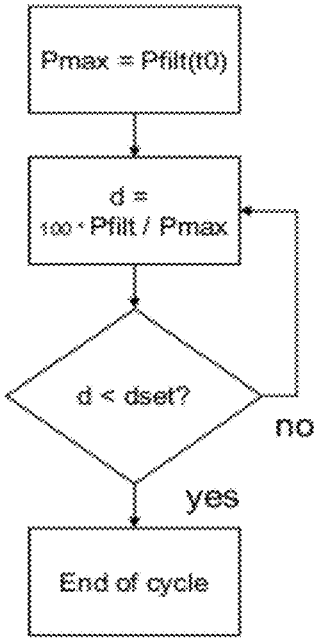
FIG. 5 is the flow chart diagram according to the invention, describing the decision sequence for stopping the drying cycle when the predetermined moisture level is reached.
Figure 6:
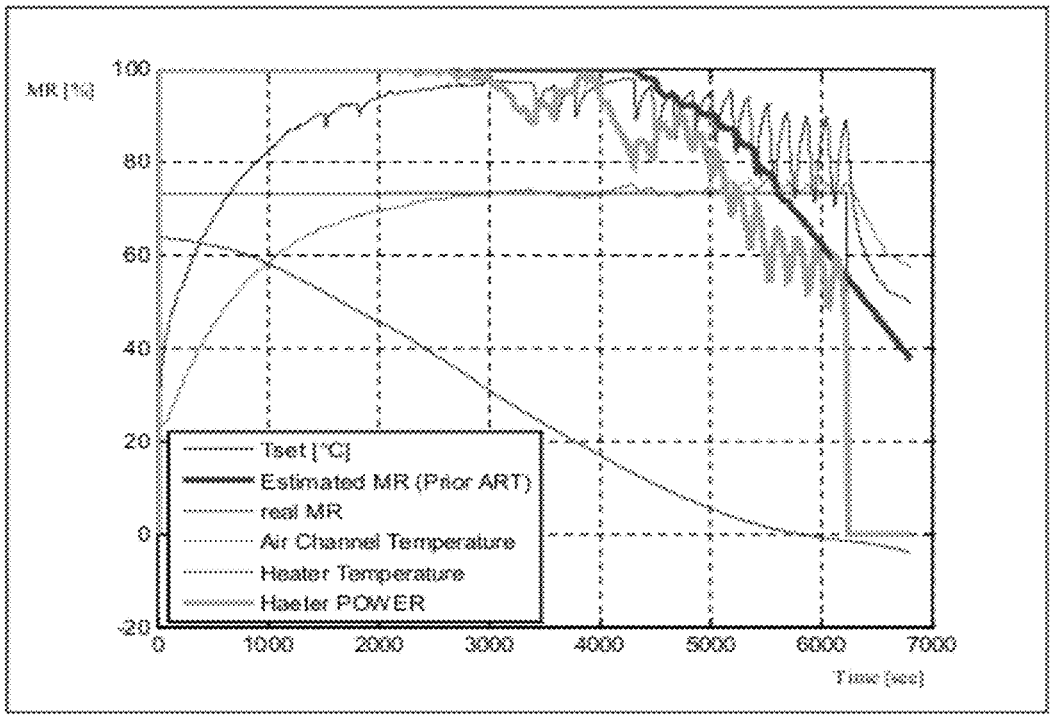
FIG. 6 shows a plot of the estimated moisture retention according to the invention compared to the real moisture content, and compared to a known method which estimates the moisture content using the signal of two temperature sensors.

With reference to FIG. 5 the drying cycle starts after the reaching of the steady state condition. The power P to be supplied by the heater is digitally filtered (for instance using an average filter of 100 sec constant time) for eliminating the superposed noise. The filter value of P is called Pfilt.

In the first step the Pfilt(t0) is assigned as Pmax. During the drying cycle the maximum Power is memorized in the Pmax variable.

$$P\max=\max(P\max,P\mathrm{filt}(t)) \tag{3}$$

During the drying phase the ratio between the Pfilt and Pmax is calculated and stored in a temporary register d and multiplied for 100.

$$d = 100 * \frac{P_{filt}}{P_{max}} \tag{4}$$

When the value of the register d (or the corresponding scaled value d %) reaches a predefined threshold $d_{SET}$ (for instance equals to 60%), which corresponds to certain % MR dryness level (for instance equals to 0%) the heating element is switched off and, and after a predefined cool down period aimed at cooling the clothes, the cycle is stopped. The user can withdraw the fabrics from the dryer, dried at the desired moisture level.

Figure 7:
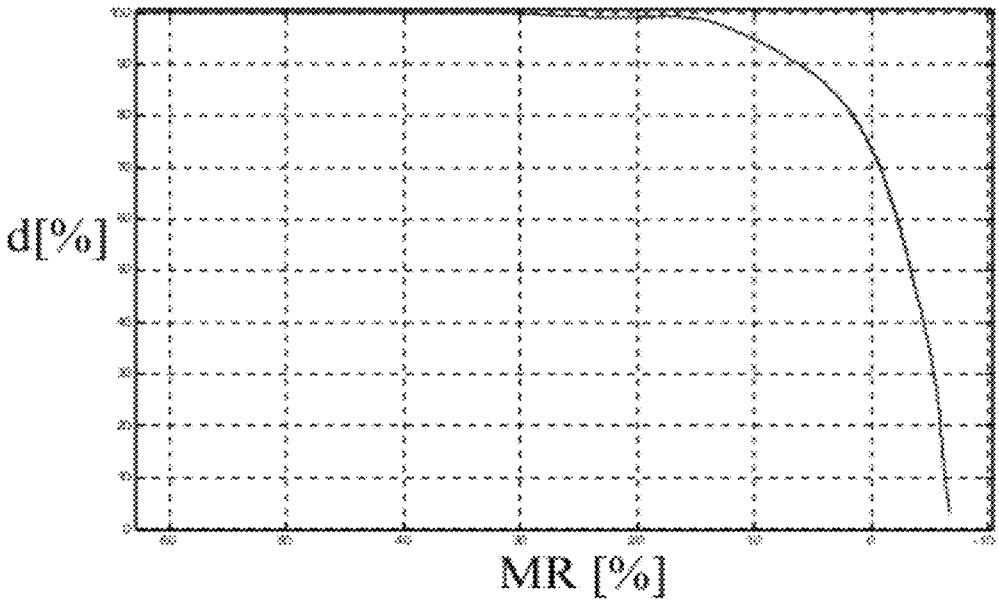
FIG. 7 shows the plot of the relationship between the moisture retention and the variable d linked with the power to be supplied by the heater according to the invention.

The relationship between d or d % and MR %, represented on FIG. 7 can be derived empirically and be memorized into the control, for instance in the form of a lookup table, or as a numerical model.

The method according to the present invention estimates the total moisture inside the mass of clothes, and not takes into account the superficial moisture like for the methods that use the conductibility sensors. In this way the algorithm assures the correct drying performance also when bulky items are loaded. In some cases the system could be used together with the stripes in order to obtain a more robust moisture control, and for further improving the performance of the drying cycle.

Moreover the method of the present invention uses the information of just one sensor (in the described example the air temperature $T_{OUT}$), which can be placed at the outlet of the drum or within the same, This sensor which measures a temperature linked with the temperature of the clothes can be any type of sensor suitable to provide such information, including a CCD or an infrared sensor.

Further, since the method of the present invention uses in input only the control signal (P) for regulating the power which has to be supplied by the heater in the control loop, the drying machine implementing the method of the present invention requires only one sensor for sensing the temperature related to the clothes, and not any additional sensor, in particular temperature sensors for controlling the heater over temperature Additional sensors can be used for further improving the performances of the method, but are not necessary for the present invention.

The verification of the use of the present invention can be simply done by measuring the absorbed power during the drying phase/cycle, using a power meter 125, as shown in FIG. 8. In this manner it is possible to verify that the residual moisture estimation and the related automatic cycle termination according to the present invention is achieved when a predetermined relative level (scaled to the maximum power value delivered during the drying phase) of the power absorption of the heater is reached. It follows that different loads for which the same drying level has been selected (automatically or set by the user) will cause the drying phase/cycle to terminate substantially at the same relative power level.

The method of the present invention can be applied on all kind of dryers, especially to condenser dryer presenting a closed loop air circulation path, and air-vented driers discharging the saturated air into the surrounding environment.

The method of the present invention can be applied either when using heat pumps, gas heaters, or systems comprising a refrigerated gas circuit, solar system or any other kind of heating system rather than resistive heating elements.

A drying cycle can finally be implemented using a plurality of drying phases according to the present invention, each phase characterized by a having a predetermined temperature set point $T_{SET}$, and its relative maximum value of power absorption max(P).

Finally the method of the present invention is applicable both to any tumble drier or to any static drier.

The invention claimed is:

1. A method for determining the residual moisture content of laundry items during a drying phase in a drier, particularly an household drier, the laundry items being dried in a drying chamber with heated air, the method comprising the steps of:

measuring a temperature related to the temperature of the laundry items;

controlling an instantaneous power supplied to a heater heating said air through a power control signal in order to maintain the temperature related to the temperature of the laundry items at a predetermined set point temperature;

operating the heater at a first power level corresponding to a first non-zero amount of instantaneous power supplied to the heater; and operating the heater at one or more lower power levels, corresponding to reduced, non-zero amounts of instantaneous power supplied to the heater, based on the temperature related to the temperature of the laundry items;

characterized in that the method comprises the step of estimating the moisture content of the laundry items by using a relationship based on the amount of instantaneous power supplied to the heater.

2. The method according to claim 1, wherein prior to estimating the moisture content, the power control signal is scaled to a maximum power value supplied during the drying phase.

3. The method according to claim 1, wherein the method is started when the temperature related to the temperature of the laundry items differs from the predetermined set point temperature of a predetermined value.

4. The method according to claim 1, further comprising the step of automatically terminating a drying cycle when the estimated moisture content reaches a predetermined level.

5. The method according to claim 1, wherein the temperature related to the temperature of the laundry items is an air temperature measured within the drying chamber or at an outlet of the drying chamber.

6. The method according to claim 1, wherein the temperature related to the temperature of the laundry items is a temperature of the laundry items.

7. The drying method for a drier comprising at least a drying phase in which a method according to claim 1, is applied, each phase being characterized by a related set point temperature level.

8. The method of claim 1, further comprising a plurality of drying phases for a drying cycle, wherein each phase is characterized as having its own predetermined temperature set point.

9. The method of claim 1, further comprising digitally filtering the power control signal to eliminate any superposed noise.

10. A drier comprising:

a drum aimed at containing a certain amount of laundry articles;

a heater to heat air to be blown inside the drum in order to dry the laundry articles;

a sensor to measure a temperature related to the temperature of the laundry articles within the drum;

a control unit for:

reading the sensor, regulating the temperature of the air blown inside the drum based on the signal temperature read by the sensor, so that the temperature related to the laundry articles is maintained at a predetermined temperature set point $T_{SET}$, the regulation being implemented by controlling an instantaneous power supplied by the heater by means of a power control signal, operating the heater at a first power level corresponding to a first non-zero amount of instantaneous power supplied by the heater, operating the heater at one or more lower power levels, corresponding to reduced, non-zero amounts of instantaneous power supplied by the heater, based on the temperature related to the laundry articles, characterized in that the control unit is suitable for implementing an estimation of the residual moisture retained from the laundry articles during a drying cycle, the estimation using the amount of instantaneous power supplied by the heater as an input, and for implementing an automatic cycle termination when the estimated moisture reaches a predetermined threshold value.

11. The drier according to claim 10, wherein the heater is in the form of a heat pump.

12. The drier according to claim 10, wherein the drier is a condensing drier or an air vented drier.

13. The drier according to claim 10, wherein the sensor is selected from a list comprising: temperature sensors, conductibility sensors, infrared sensors, CCD sensors.

14. The drier according to claim 10, wherein the drier is a tumble drier.

15. The drier according to claim 10, wherein the drier is a static drier.

16. The drier according to claim 10, wherein the heater is in the form of a resistive heating element.

17. A method for determining a residual moisture content of laundry items in a household drier, having a drum containing the laundry items, a heater to heat air to be blown inside the drum in order to dry the laundry items, a sensor to measure a temperature related to that of the laundry items within the drum and a control unit connected to both the sensor and the heater, during a drying cycle, the method comprising:

measuring the temperature related to that of the laundry items within the drum with the sensor;

controlling instantaneous power supplied to the heater through a power control signal from the control unit in order to maintain the temperature at a predetermined temperature set point;

operating the heater at a first power level corresponding to a first non-zero amount of instantaneous power supplied to the heater;

operating the heater at one or more lower power levels, corresponding to reduced, non-zero amounts of instantaneous power supplied to the heater, based on the temperature related to that of the laundry items; and estimating the residual moisture content of the laundry items from the amount of instantaneous power supplied to the heater.

18. The method of claim 17, further comprising digitally filtering the power control signal to eliminate any superposed noise.

19. The method of claim 17, further comprising establishing a plurality of drying phases for the drying cycle, wherein each phase is characterized as having its own predetermined temperature set point.

* * * * *